US006653542B2

(12) United States Patent
Suzuki et al.

(10) Patent No.: US 6,653,542 B2
(45) Date of Patent: Nov. 25, 2003

(54) KEYBOARD DEVICE FOR ELECTRONIC KEYBOARD MUSICAL INSTRUMENT

(75) Inventors: Akihiro Suzuki, Hamamatsu (JP); Yoshiaki Shimoda, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/136,369

(22) Filed: May 2, 2002

(65) Prior Publication Data

US 2002/0194982 A1 Dec. 26, 2002

(30) Foreign Application Priority Data

Jun. 26, 2001 (JP) ..... 2001-193457

(51) Int. Cl.[7] ..... G10D 13/02
(52) U.S. Cl. ..... 84/423 R
(58) Field of Search ..... 84/423 R, 424, 84/425, 433, 436, 438, 439, 442

(56) References Cited

U.S. PATENT DOCUMENTS 4,587,877 A * 5/1986 Zacharias ..... 84/687
6,362,412 B1 * 3/2002 Ura ..... 84/658
6,444,885 B2 * 9/2002 Meisel ..... 84/16

* cited by examiner

*Primary Examiner*—Kimberly Lockett
(74) *Attorney, Agent, or Firm*—Crowell & Moring LLP

(57) ABSTRACT

A keyboard device for an electronic keyboard musical instrument is provided for reducing the manufacturing cost by reducing the number of parts and the number of assembling steps associated with the attachment of a substrate, and securely attaching the substrate to a chassis through a spacer. The keyboard device comprises a plurality of keys; a chassis for supporting a plurality of keys; a substrate attached to the chassis for detecting information on depression on the keys; and a spacer interposed between the substrate and chassis. The spacer has tabs for preventing rotation, while the substrate is formed with engaging holes. The spacer is attached to the substrate with the tabs in engagement with the engaging holes. The substrate is attached to the chassis with a first screw driven into the spacer through the chassis.

3 Claims, 6 Drawing Sheets

KEYBOARD DEVICE FOR ELECTRONIC KEYBOARD MUSICAL INSTRUMENT

BACKGROUND OF THE INVENTION

1. Field of the Invention

The present invention relates to a keyboard device for an electronic keyboard musical instrument such as an electronic piano, which has a substrate attached through a spacer for detecting information on a key depressed on a keyboard.

2. Description of the Prior Art

FIG. 1 illustrates an exemplary keyboard device for a conventional electronic piano, where one each of black and white keys are shown in an unpressed state. The illustrated keyboard device 31 comprises a multiplicity of keys 33 arranged from left to right (in the depth direction in FIG. 1) (only one each of which is shown); a chassis 32 for supporting the keys 33; a multiplicity of hammers 34 (only one of which is shown) arranged for pivotal movement associated with depression on each key 33; and the like. Each of the keys 33 is pivotably supported by a balance pin 36 (only one of which is shown) implanted on the chassis 32 in a central portion of the key 33 in the longitudinal direction (in a horizontal direction in FIG. 1). The chassis 32 is horizontally fixed to a keybed 35 with screws 35*a*.

The hammer 34 is supported by a hammer rail 37. The hammer rail 37 is provided with a plurality of action ribs 39 attached at predetermined intervals in the horizontal direction with a multiplicity of screws 40 (only two of which are shown). Further, a stopper rail 41 is attached to these action ribs 39 with a multiplicity of screws 42 (only two of which are shown), and extend from left to right to cover all the hammers 34. Above the hammer 34, a key switch 45 is further disposed for detecting information on depression on a key 33 associated therewith. The key switch 45 comprises a substrate 46, and a switch body 47 attached to the substrate 46 for each key 33, and is attached to the action rib 39 in the following manner.

First, the substrate 46 is attached to the stopper rail 41 by driving a screw 48 into the stopper rail 41 through a spacer 48 from the lower surface of the substrate 46. Next, with a rear end portion of the substrate 46 inserted into an engaging recess 43*a* of a fulcrum member 43, the stopper rail 41 is secured to the action rib 39 from above with the screws 42, whereby the key switch 45 is attached to the action rib 39.

In the foregoing manner, the stopper rail 41 is provided separately from the action rib 39, and the stopper rail 41 is attached to the substrate 46, followed by the attachment of the stopper rail 41 to the action rib 39 from above with the screws 42. Such an attachment process is employed by the following reason. If the stopper rail 41 was integrally formed with the action rib 39, the substrate 46 would have to be attached to the action rib 39 from below with screws, in which case the key 33 and hammer 34 would impede a driver from accessing the screws, resulting in difficulties in assembly and disassembly of the keyboard.

Another conventional keyboard device illustrated in FIG. 2 is also known. In the illustrated keyboard device 51, a hammer rail 52 comprises integrally formed hammer rail 37, action rib 39 and stopper rail 41 illustrated in FIG. 1. A cylindrical spacer 66 has been previously formed with a screw hole 66*c*. For attaching a substrate 56 to the hammer rail 52, a screw 66*b* is first driven into the screw hole 66*c* of the spacer 66 through the substrate 56 to attach the substrate 56 to the spacer 66. Next, with one end portion of the substrate 56 inserted into an engaging recess 52*a* of the hammer rail 52, a screw 66*a* is driven into the screw hole 66*c* of the spacer 66 through the hammer rail 52 to attach the substrate 56 to the hammer rail 52 through the spacer 66.

The conventional keyboard device 31 illustrated in FIG. 1, however, has the disadvantage of a large number of required parts and low assembling accuracy due to the separately provided action rib 39 and stopper rail 41. In addition, since the substrate 46 is attached to the stopper rail 41 with the screws 48*a*, and the stopper rail 41 is also attached to the action rib 39 with the screws 42, a larger number of assembling steps are required, resulting in an increase in the manufacturing cost.

The conventional keyboard device 51 illustrated in FIG. 2 in turn eliminates the aforementioned problem because the hammer rail 52 is composed of the integrally formed action rib 39 and stopper rail 41 in FIG. 1. However, when the spacer 66 is attached to the substrate 56 with the screw 66*b*, the spacer 66, which rotates together with the screw 66*b*, causes difficulties in driving the screw 66*b* into the screw hole 66*c*. In addition, when the screw 66*a* is loosened for disassembly, the spacer 66, which rotates together with the screw 66*a*, causes the screw 66*b* to readily loosen. For this reason, a rotation preventing tool must be used for preventing such associative rotation, with additional efforts required for this work. The conventional keyboard device 51 has an additional problem of the requirement of expense for previously forming the screw hole 66*c* in the spacer 66.

OBJECT AND SUMMARY OF THE INVENTION

The present invention has been made to solve the problems as mentioned above, and it is an object of the invention to provide a keyboard device for an electronic keyboard music instrument which is capable of reducing the manufacturing cost by reducing the number of parts and the number of assembling steps associated with the attachment of the substrate, and of securely attaching the substrate to a chassis through a spacer.

To achieve the above object, a keyboard device for an electronic musical instrument according to the present invention is characterized by comprising a keyboard device for an electronic musical instrument, characterized by comprising a plurality of keys; a chassis for supporting the plurality of keys; a substrate having an engaging hole and attached to the chassis for detecting information on depression on the plurality of keys; a spacer having a tab for preventing rotation and interposed between the substrate and the chassis such that the spacer is attached to the substrate with the tab in engagement with the engaging hole; and a first screw driven into the spacer through the chassis for attaching the substrate to the chassis.

According to this keyboard device for an electronic keyboard musical instrument, the spacer is attached to the substrate by engaging the tab for preventing rotation into the engaging hole of the substrate. The substrate in turn is attached to the chassis with the first screw driven into the spacer through the chassis. Thus, since the spacer is prevented from rotating relative to the substrate by the engaged tab when the substrate is attached to the chassis, the substrate can be readily attached to the chassis without using a special tool for preventing the rotation when the first screw is fastened.

In the foregoing keyboard device, the tab is preferably elastic, and snap fitted into the engaging hole of the substrate.

According to this preferred embodiment of the keyboard device, the tab of the spacer is snap fitted into the engaging hole of the substrate, taking advantage of elasticity, so that the spacer can be readily attached to the substrate in a single motion while it is prevented from coming off.

In the foregoing keyboard device, the spacer is preferably fixed to the substrate with a second screw driven into the spacer through the substrate.

According to this preferred embodiment of the keyboard device, the spacer can be securely fixed to the substrate without saccadic movements by driving the second screw into the spacer through the substrate. In this event, it is possible to omit a process for threading the spacer, as before, by previously forming a lower hole in the spacer and using a tapping screw for the second screw.

DETAILED DESCRIPTION OF THE EMBODIMENT

Figure 1:
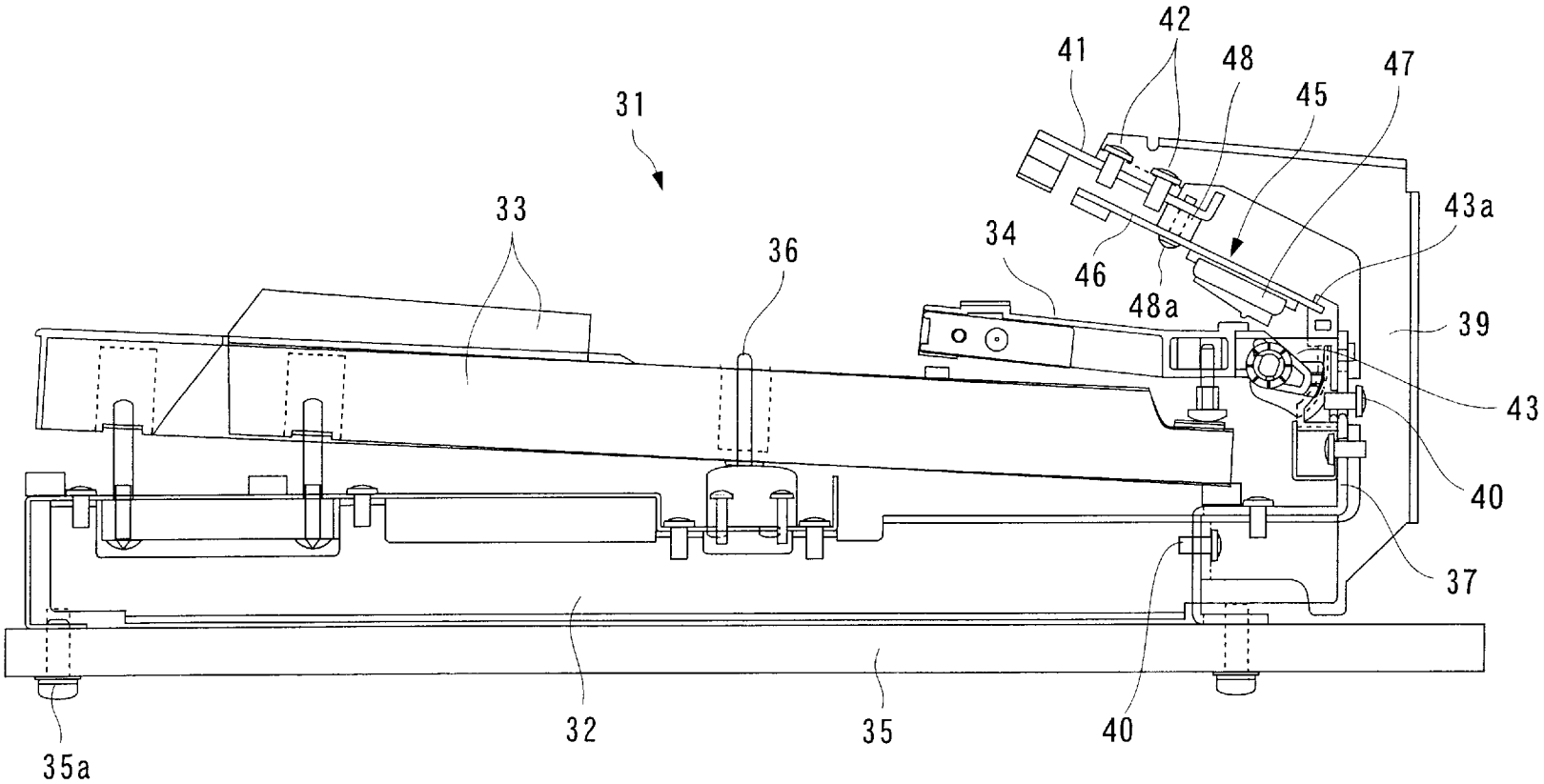
FIG. 1 PRIOR ART
FIG. 1 is a side view illustrating a conventional keyboard device for an electronic piano.
Figure 2:
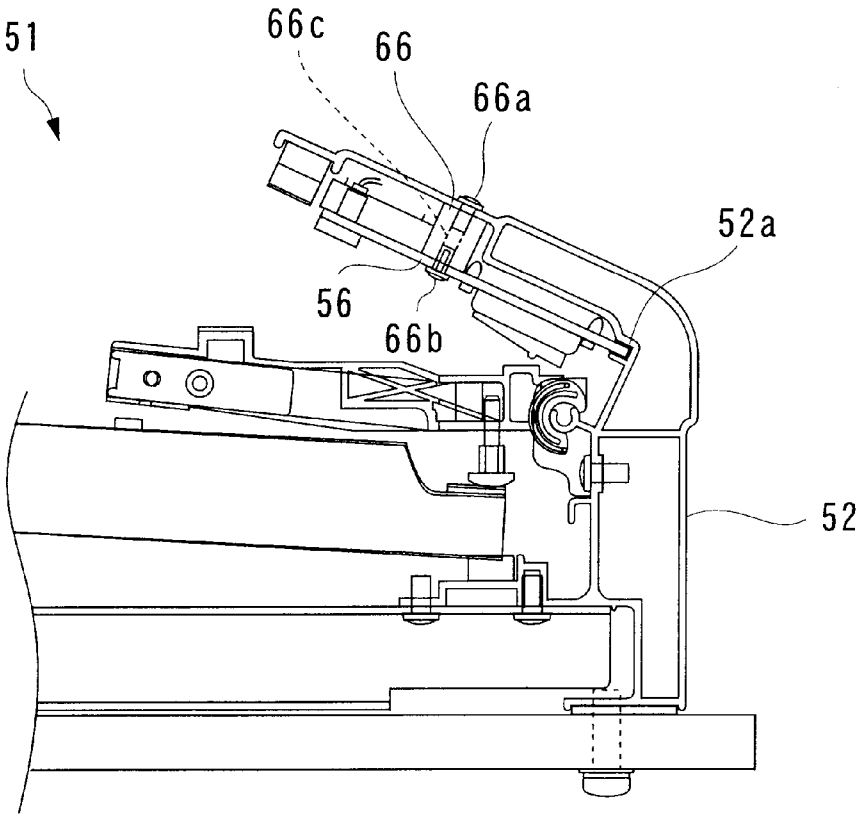
FIG. 2 PRIOR ART
FIG. 2 is a side view illustrating another conventional keyboard device for an electronic piano.
Figure 3:
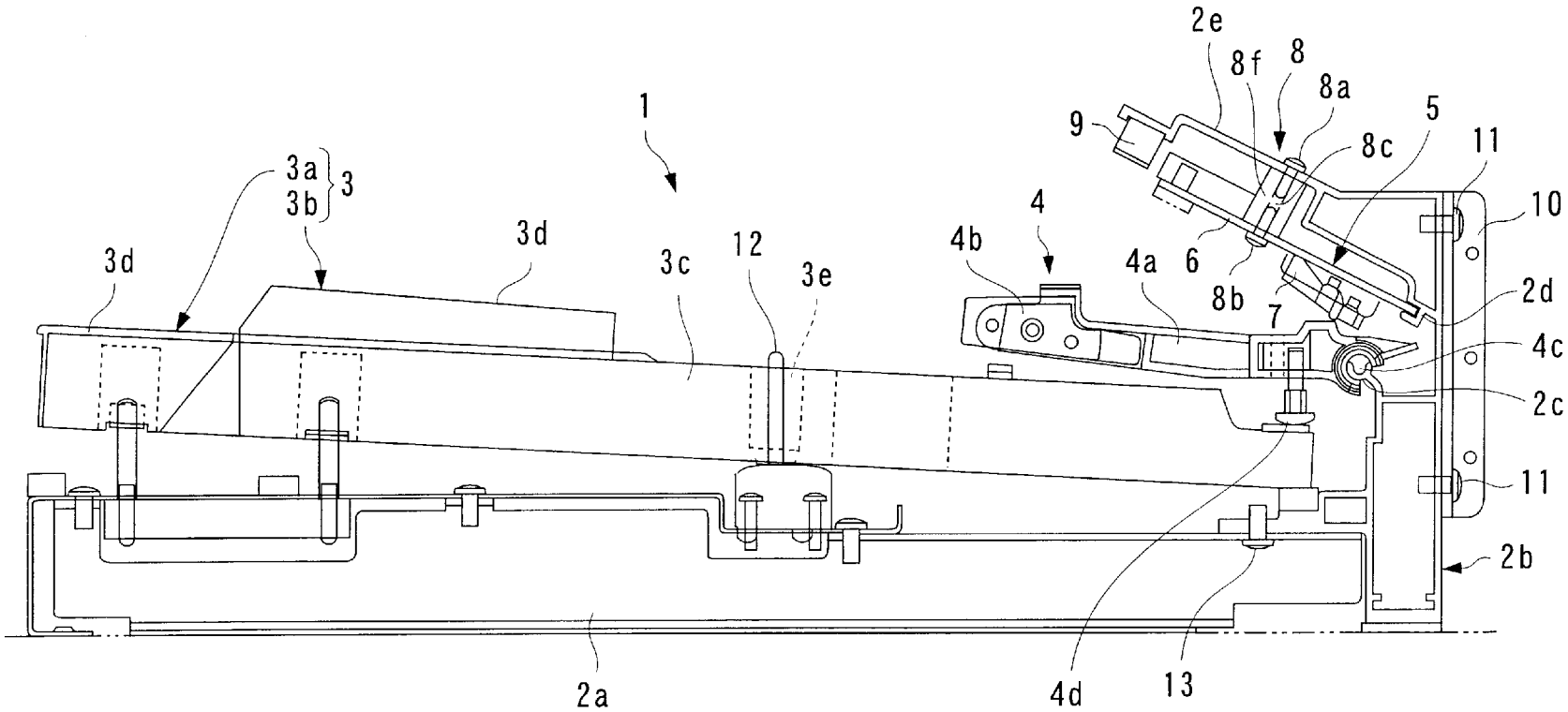
FIG. 3 is a side view illustrating a keyboard device for an electronic piano which embodies a keyboard device according to one embodiment of the present invention.

In the following, a preferred embodiment of the present invention will be described in detail with reference to the accompanying drawings. FIG. 3 illustrates a keyboard device for an electronic piano according to one embodiment of the present invention in an unpressed state.

The illustrated keyboard device 1 comprises a multiplicity of keys 3 (only one each of white key 3*a* and black key 3*b* is shown) arranged from left to right; a lower chassis 2*a* for supporting these keys 3; a rear chassis 2*b* attached to a rear end portion of the lower chassis 2*a*; a multiplicity of hammers (only one of which is shown) arranged for pivotal movement associated with depression on associated keys 3.

The lower chassis 2*a* is formed by assembling steel plates or the like punched and bent by a press into parallel crosses. A multiplicity of balance pins 12 (only one of which is shown) are implanted side by side from left to right in a central portion of the lower chassis 2*a* in the depth direction. Each of the keys 3 is pivotably supported at a central portion by an associated balance pin 12.

The keys 3 are comprised of the white keys 3*a* and black keys 3*b*, each of which comprises a key body 3*c* made of wood in the shape of rectangle in cross section, and a key cover 3*d* made of a synthetic resin and adhered in a front portion of the top of the key body 3*c*. A balance pin hole 3*e* is formed in a central portion of the key body 3*c*. The key 3 is pivotably supported by the balance pin 12 through the balance pin hole 3*e*.

The hammer 4, which is provided for each key 3, comprises a rod-shaped hammer body 4*a* made of a synthetic resin, and a pair of weight plates (only one of which is shown) attached to fronts portion of both side surfaces of the hammer body 4*a*. The hammer body 4*a* is formed with an arcuate shaft hole 4*c*, open to the rear, in a rear end portion. The hammer 4 is pivotably supported by the rear chassis 2*b* by the shaft hole 4*c* in engagement with a fulcrum shaft 2*c* of the rear chassis 2*b*, later described. An adjustable screw 4*d* is attached at a location near the shaft hole 4*c* on the bottom of the hammer body 4*a* for back and forth movements. The hammer 4 is carried on a rear end portion of the top of the corresponding key 3 through the adjustable screw 4*d*.

The rear chassis 2*b* (chassis) is formed of a single hollow extrusion molding made of aluminum, extends from left to right to cover all the hammers 4, and is coupled to the lower chassis 2*a* with screws 13 and fixed to the keybed (not shown) with screws (not shown). A reinforcement plate 10 is attached to a rear portion of the rear chassis 2*b* with screws 11. The rear chassis 2*b*, which extends in the vertical direction, has a substrate attachment 2*e* which extends diagonally upward in front from the top end of the rear chassis 2*b*. A stopper 9 is disposed at the leading end of the substrate attachment 2*e* for restricting upward pivotal movements of the hammer 4. The stopper 9 also extends from left to right to cover all the hammers 4.

A key switch 5 is further disposed above the hammer 4 for detecting information on depression on each key 3 associated therewith. The key switch 5 comprises a substrate 6, and a switch body 7 attached to the substrate 6 for each key 3. The substrate 6 is attached to the substrate attachment 2*e* with a first screw 8*a* and a second screw 8*b* through a spacer 8 with a rear end portion thereof inserted into an engaging recess 2*d* formed in an intermediate portion of the rear chassis 2*b*.

Figure 4A:
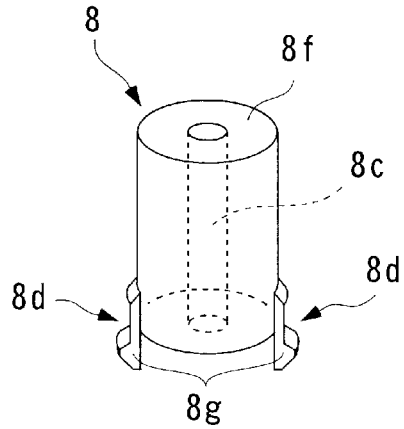
FIGS. 4A and 4B are respectively a perspective view and a cross-sectional view of a spacer used in the keyboard device of FIG. 3.
Figure 4B:
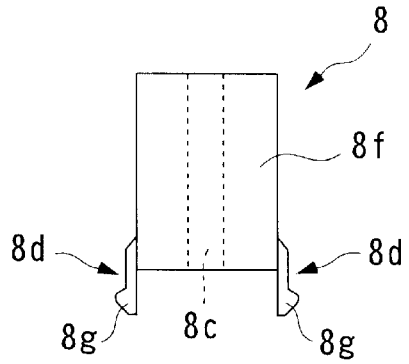
Figure 5A:
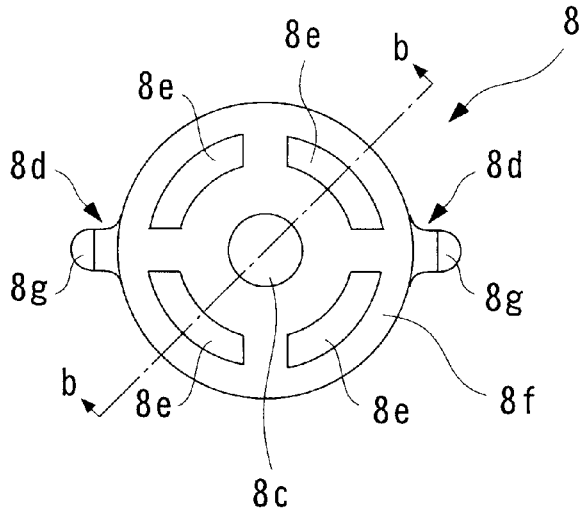
FIGS. 5A and 5B are respectively a plan view and a cross-sectional view taken along a line b—b illustrating the spacer of FIG. 4.
Figure 5B:
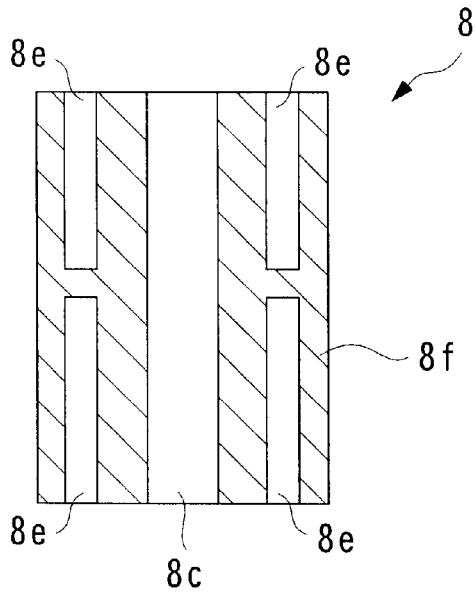

The spacer 8, which is formed of a molding made of a synthetic resin such as polyacetals, comprises a cylindrical spacer body 8*f*, and two tabs 8*g* protruding downward from the spacer body 8*f*, as illustrated in FIGS. 4A and 4B. Each of the tabs 8*d* has a certain degree of elasticity, resulting from the foregoing configuration, and is formed with protrusions 8*b* protruding outward from the leading end. The spacer body 8*f* is formed with a lower hole 8*c* extending through a central portion thereof for attaching the spacer 8 to the substrate 6 and substrate attachment 2*e*. Also, as illustrated in FIG. 5, the spacer body 8*f* is formed with a total of eight holes at four locations on the top and bottom for preventing sinking after molding.

Figure 4C:
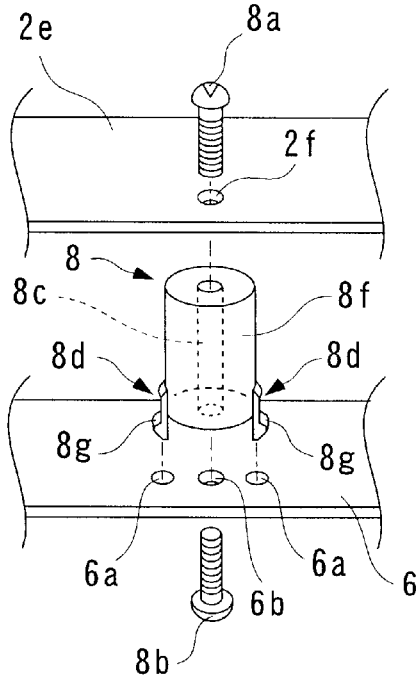
FIG. 4C is a perspective view illustrating a substrate and a substrate attachment used in the keyboard device of FIG. 3.

Also, as illustrated in FIG. 4C, the substrate 6 is formed with engaging holes 6*a* corresponding to the tabs 8*d*, respectively, and with a hole 6*b* for the second screw 8*b* at an intermediate location between the engaging holes 6*a*. Likewise, the substrate attachment 2*e* of the rear chassis 2*b* is also formed with a hole 2*f* for the first screw 8*a*. The first screw 8*a* and second screw 8*b* are used as tapping screws.

Figure 6A:
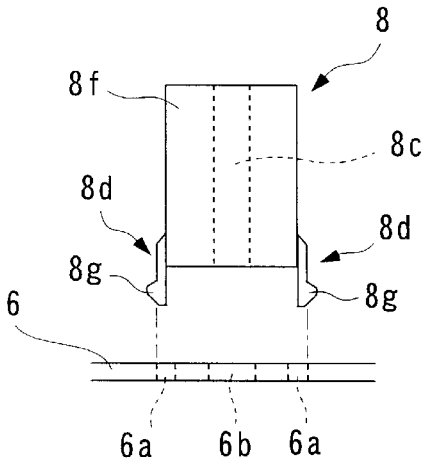
FIGS. 6A–6D are diagrams showing a method of attaching the substrate to the chassis using the spacer of FIG. 4.
Figure 6B:
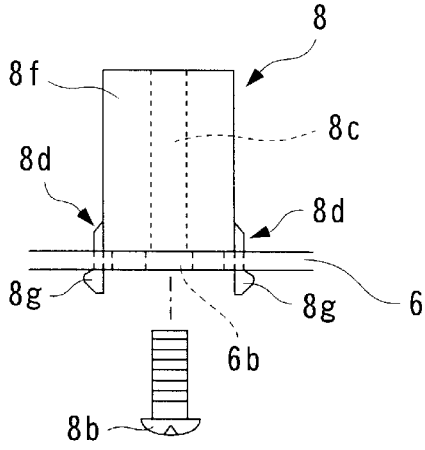
Figure 6C:
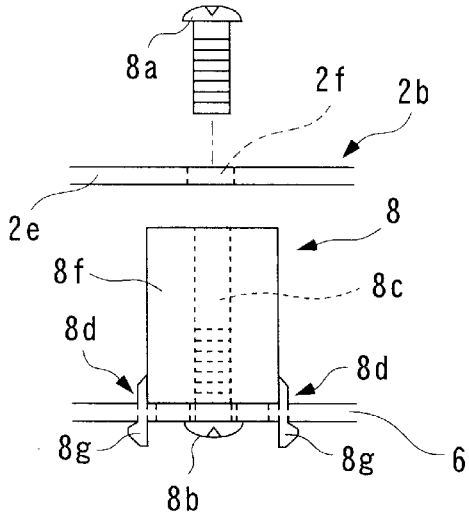
Figure 6D:
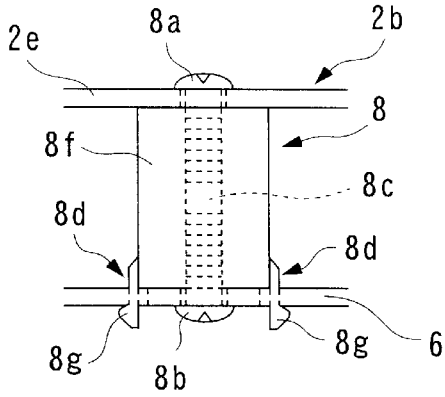

Next, a method of attaching the substrate 6 to the rear chassis 2*b* using the spacer 8 in the foregoing structure will be described with reference to FIGS. 6A–6D. First, as illustrated in FIG. 6A, the protrusions 8*g* of the spacer 8 are respectively inserted into the engaging holes 6*a* of the substrate 6 while pressing the tabs 8*d* with fingers. Subsequently, as the fingers are moved off the tabs 8*d*, the inserted tabs 8*d* elastically return to the original shape to snap fit the protrusions 8*g* into the engaging holes 6*a* such that the protrusions 8*g* will not come off (FIG. 6B). Next, the second screw 8*b* is inserted through the hole 6*b* of the substrate 6 from below and driven into the lower hole 8*c* of the spacer 8 to securely fix the spacer 8 to the substrate 6 (FIGS. 6B, 6C). Next, after a rear end portion of the substrate 6 is inserted into the engaging recess 2*d* of the rear chassis 2*b*, the first screw 8*a* is inserted through the hole 2*f* of the substrate attachment 2*e* from above, and driven into the lower hole 8*c* of the spacer 8 to attach the substrate 6 to the substrate attachment 2*e* (FIGS. 6C, 6D). In this way, the substrate 6 is attached to the substrate attachment 2*e* through the spacer 8.

As described above, according to the foregoing embodiment, the spacer 8 is attached to the substrate 6 by engaging the tabs 8 for preventing the spacer 8 from rotating into the engaging hole 6*a* of the substrate 6. Therefore, when the substrate 6 is attached to the substrate attachment 2*e* with the first screw 8*a* which is driven into the spacer 8 through the substrate attachment 2*e*, the spacer 8 is prevented from rotating relative to the substrate 6 by the engaged tabs 8*d*. This facilitates the attachment of the substrate 6 to the substrate attachment 2*e* without using a special tool for preventing the rotation when the first screw 8*a* is fastened. In addition, when the substrate 6 is disassembled for purposes of maintenance or the like, the spacer 6 is prevented from rotating relative to the substrate 6 by the engaged tabs 8*b* when the first screw 8*a* is loosened.

Also, since the tabs 8*d* of the spacer 8 are snap fitted in the engaging holes 6*a* of the substrate 6, taking advantage of elasticity, the spacer 8 can be readily attached to the substrate in a single motion while it is prevented from coming off.

Further, the spacer 8 can be securely fixed to the substrate 6 without saccadic movements by driving the second screw 8*b* into the spacer 8 through the substrate 6. In this event, since the spacer 8 is previously formed with the lower hole 8*c* and a tapping screw is used as the second screw 8*b*, it is possible to omit a process for threading the spacer 8 which has been required in the prior art.

It should be understood that the present invention is not limited to the foregoing embodiment but can be practiced in a variety of implementations. For example, while the foregoing embodiment employs the spacer formed with two tabs, the spacer may be formed with a single or three or more tabs instead of two. In this event, the spacer can be attached to the substrate likewise while preventing the rotation. Also, in the foregoing embodiment, the tabs of the spacer are snap fitted into the engaging holes of the substrate by the action of the protrusions formed at the leading ends of the tabs of the spacer. Alternatively, a tab without such protrusions may be simply inserted into the engaging hole of the substrate. With such a tab, the spacer can be likewise prevented from rotating relative to the substrate.

As described above in detail, the keyboard device for an electronic keyboard musical instrument according to the present invention is advantageous in that the manufacturing cost can be reduced by reducing the number of parts and the number of assembling steps associated with the attachment of the substrate, and that the substrate can be securely fixed to the chassis through the spacer.

What is claimed is:

1. A keyboard device for an electronic musical instrument, comprising:

a plurality of keys;

a chassis for supporting said plurality of keys;

a substrate attached to said chassis for detecting information on depression on said plurality of keys, said substrate having an engaging hole;

a spacer interposed between said substrate and said chassis, said spacer having a tab for preventing rotation, such that said spacer is attached to said substrate with said tab in engagement with said engaging hole; and a first screw driven into said spacer through said chassis for attaching said substrate to said chassis.

2. A keyboard device for an electronic keyboard musical instrument according to claim 1, wherein said tab is elastic, and snap fitted into said engaging hole of said substrate.

3. A keyboard device for an electronic keyboard musical instrument according to claim 2, wherein said spacer is fixed to said substrate with a second screw driven into said spacer through said substrate.

* * * * *